United States Patent [19]

Hughes

[11] 4,056,046

[45] Nov. 1, 1977

[54] APPARATUS FOR FOLDING AND GLUING CARTON BLANKS

[75] Inventor: Charles C. Hughes, Ludlow, Ky.

[73] Assignee: R. A. Jones & Co. Inc., Covington, Ky.

[21] Appl. No.: 690,644

[22] Filed: May 27, 1976

[51] Int. Cl.[2] ..... B31B 1/56

[52] U.S. Cl. ..... 93/49 R; 93/52

[58] Field of Search ..... 93/52, 49 R, 48, 45, 93/41, 36.3, 46, 50, 49 AC; 198/832

[56] References Cited

U.S. PATENT DOCUMENTS

| | | | |
|---|---|---|---|
| 603,471 | 5/1898 | Low | 93/52 |
| 890,464 | 6/1908 | Staude | 93/48 |
| 2,125,147 | 7/1938 | Bergstein | 93/52 X |
| 2,637,251 | 5/1953 | Spiess | 93/49 R |
| 2,850,953 | 9/1958 | Barker et al. | 93/49 R X |
| 2,899,873 | 8/1959 | LaBombard | 93/52 |
| 3,116,920 | 1/1964 | Geer et al. | 93/52 X |

*Primary Examiner*—James F. Coan

*Attorney, Agent, or Firm*—Wood, Herron & Evans

[57] ABSTRACT

Flat open carton blanks are fed by a conveyor past two rotating plows located on each side of the conveyor. A first plow is located upstream of the second plow, and a glue applicator is located between the two plows. A stationary plow or wedge is located ahead of each rotating plow. As the blank is advanced, a first panel is folded upon the blank by the first rotating plow. Glue is applied to the edge of the first panel. As the blank is conveyed past the second rotating plow, a panel on the opposite side of the blank is folded upon the blank with its edge in contact with the glue applied to the edge of the first panel. The thus folded blank is passed through the nip of press rolls to press the two glued edges together. A diverter is provided to reject double folded blanks.

8 Claims, 7 Drawing Figures

APPARATUS FOR FOLDING AND GLUING CARTON BLANKS

This invention relates to apparatus for folding and gluing carton blanks to form flat folded side-seamed blanks which are subsequently opened into tubular shapes, filled with product and closed.

In cartoning apparatus, flat-folded cartons are fed from a magazine, erected, filled with a product and sealed. The packaging company which operates the cartoning apparatus has two principal alternatives for providing a supply of folded carbon blanks.

First, the packager may obtain the flat-folded blanks from the converter which first forms the blanks, creases them, folds them and forms a glued seam. In this form, the blanks are shipped to the packager. The packager may simply load the pre-folded and glued carton blanks into the magazine of the cartoning machine and thereafter perform the steps of cartoning on the apparatus.

Alternatively, the packager may obtain flat, open carton blanks from the converter and, on apparatus provided for that purpose, perform the folding and sealing operations. The folding and sealing apparatus preferably is associated with the cartoning apparatus so as to continuously supply carton blanks as required by the cartoner, or, alternatively, the carton blanks can be first formed, stored and then used as required.

The first approach, that is, obtaining folded and sealed carton blanks from the converter, has its disadvantages. The cost of the carton blanks is increased. There is an additional cost for storage and handling. More importantly, however, the carton blanks when stored become compacted by the weight of the blanks upon one another and thus are more difficult to open on the cartoning apparatus.

The alternative approach of folding and sealing the carton blanks on apparatus associated with a cartoner, while preferred, has the disadvantage that the folding and sealing apparatus heretofore known has been quite large and thus requires considerable floor space alongside the cartoning apparatus. Such folding and sealing apparatus is exemplified by U.S. Pat. No. 3,418,892.

That apparatus which employs a conveyor for moving carton blanks past stationary plows to effect the folding operation has, in practice, a length of about twenty-eight feet.

An objective of the present invention has been to provide apparatus which efficiently folds and seals carton blanks and in practice requires a length of only about nine feet.

A principal structural feature of the invention which enables the apparatus to fold the cartons in a short excursion on the apparatus conveyor is a pair of rotating plows on each side of the conveyor and spaced longitudinally from each other. The rotating plows, cooperating with wedge-shaped stationary plows which start the folding of the outboard panels, cause the outboard panels to be folded at an angle of approximately 180°. In one rotation of a rotating plow, it is possible to fold a panel upon itself, thereby eliminating the need for a series of stationary plows which gradually effect the folding of the panels upon the blank.

Another objective of the invention has been to provide, in the conveyor for the blanks, a drive mechanism which grips the blanks securely to move them through the operating sections. This drive mechanism includes, on both sides of the conveyor, at least one pressure section consisting of alternating upper and lower rollers between which a conveyor belt passes carrying a carton blank. The tension on the belt, interacting with the rollers, causes the blank to be securely gripped as it is conveyed through the machine. Normally, only one side of a blank is gripped while the other side is moved through an operating station.

Another objective of the invention has been to provide a detector and eject mechanism which detects a condition of two or more blanks folded together and causes them to be ejected from the system instead of being dropped into the magazine of the cartoning apparatus.

The several features and objectives of the present invention will become more readily apparent from the following detailed description taken in conjunction with the accompanying drawings in which:

FIG. 7 is a cross-sectional view taken along line 7—7 of FIG. 3 illustrating the creasing rolls.

Figures 1, 3, 4, 6:
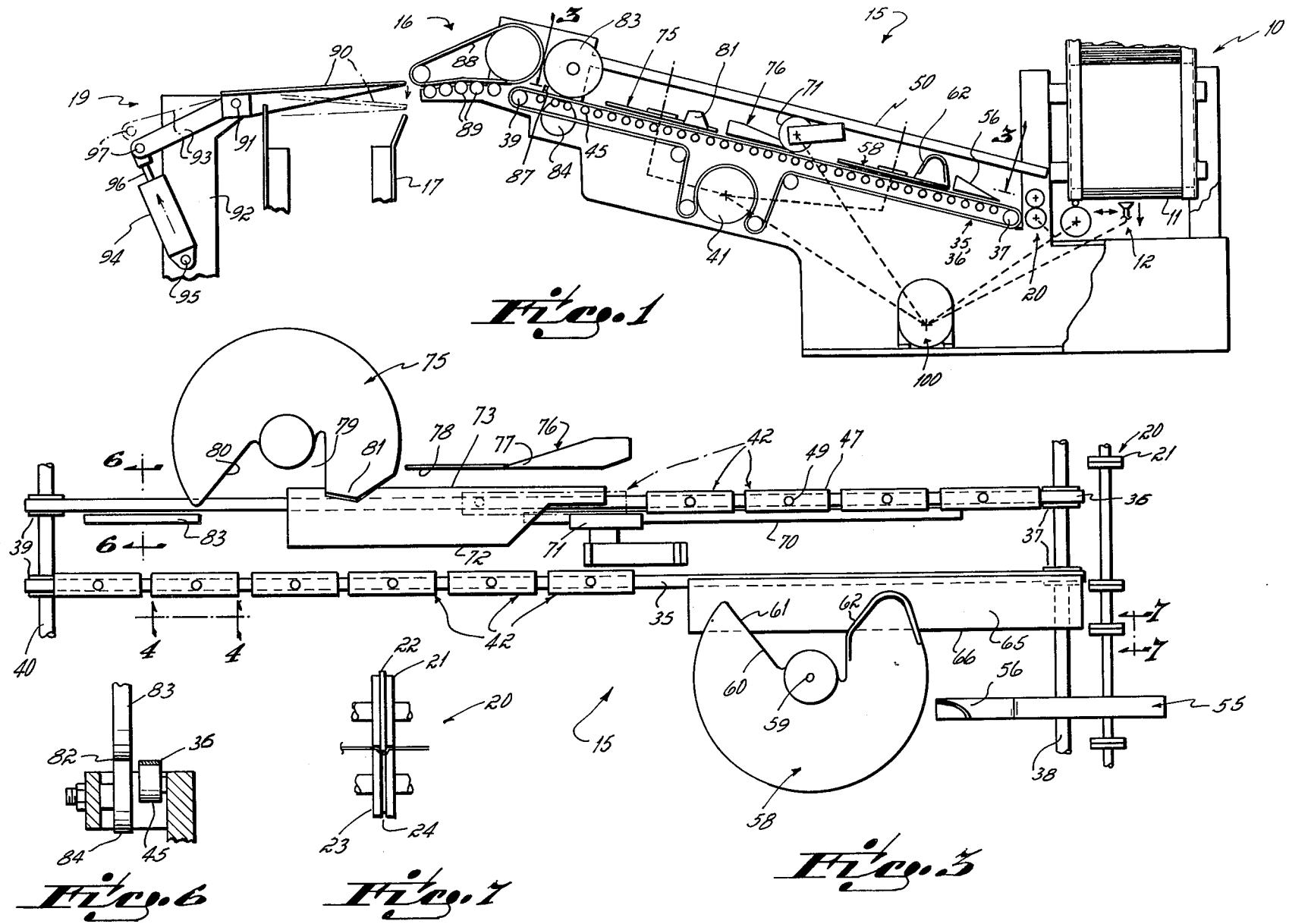
FIG. 1 is a diagrammatical side elevational view of the apparatus.
FIG. 3 is a top plan view of the folding and sealing mechanism taken along line 3—3 of FIG. 1.
FIG. 4 is a side elevational view of a pressure section for driving the carton blanks through the apparatus and taken along line 4—4 of FIG. 3.
FIG. 6 is a cross-sectional view taken along line 6—6 of FIG. 3 illustrating the press rolls through which the blank is fed.
Figure 4:
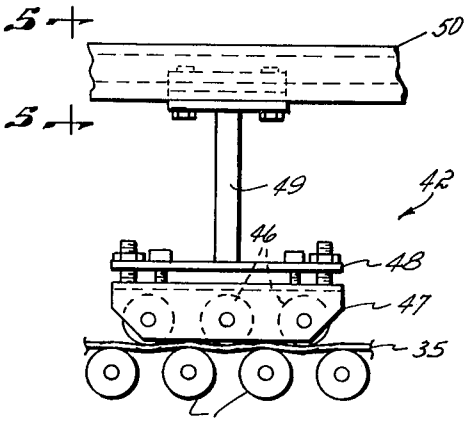
Figure 5:
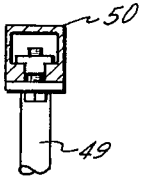
FIG. 5 is a cross-sectional view taken along line 5—5 of FIG. 4.

As diagrammatically shown in FIG. 1, the apparatus includes a magazine 10 containing a supply of flat carton blanks 11. An ejector mechanism 12 at the lower portion of the magazine 10 causes the carton blanks to be fed out from the bottom of the magazine and into the folding and sealing mechanism 15. In the folding and sealing mechanism 15, the outboard panels of the blank are folded upon the blank, glue is applied and the thus folded and sealed blanks are ejected from the downstream end of the mechanism by an ejector 16.

Preferably, the folding and sealing mechanism is associated with a cartoner located at the downstream end of the folding and sealing mechanism. The cartoner, which is not shown, has a magazine indicated at 17 which receives the folded carton blanks redy for discharge into the cartoning apparatus. A reject mechanism 19, to be described below, is provided to divert double blanks from going into the cartoner magazine.

Figure 2:
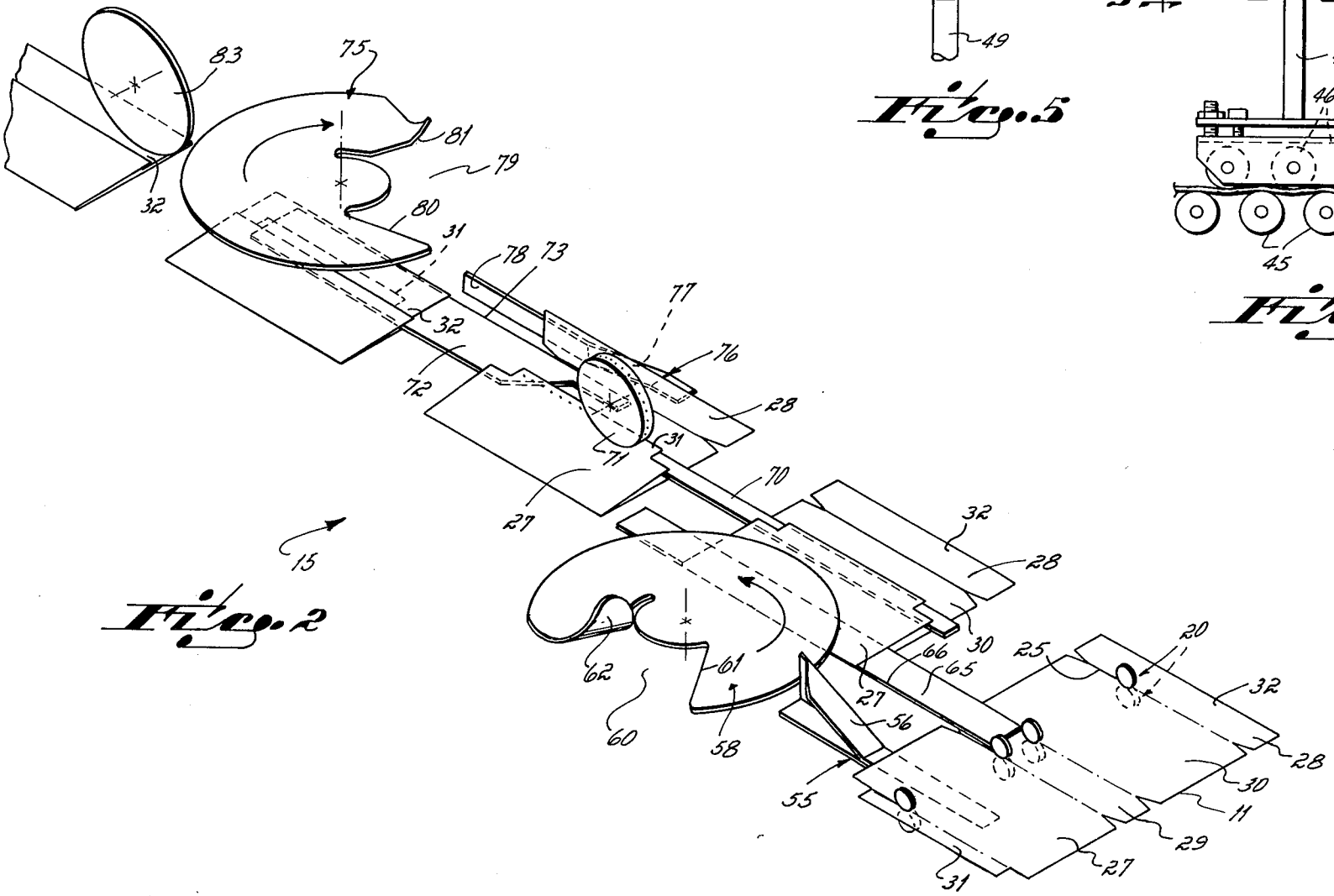
FIG. 2 is a diagrammatical perspective view illustrating the folding and sealing mechanism.

Referring to FIGS. 2, 3 and 7, the folding and sealing mechanism 15 has, at its upstream end, four creasing rolls 20. The creasing rolls include an upper roll 21 and a rim 22 and a lower roll 23 having a groove 24 which cooperates with the rim 22. The rim 22 and groove 24 mate and form a crease 25 in the blank at each of four fold lines in order to facilitate the folding of the blank. As shown in FIG. 2, the crease or fold lines divide the blank into two outboard panels 27 and 28, two inboard panels 29 and 30 and a glue flap 31 which forms the edge portion of the panel 27.

While four creasing rolls are shown, it is sometimes desirable to eliminate the two rolls which form creases along the line about which the panels will be formed in the mechanism. Some carton blanks would be unduly weakened if subjected to both creasing and folding in the mechanism, and with these it is not necessary to first form a crease in order to have a good folding operation. Other stiffer carton blanks require a preliminary crease in order to have a good folding operation.

In the operation of the invention, the panel 27 will be folded through approximately 180° to overlie the panels 29 and 30. Glue will be applied to the glue flap 31 and then the panel 28 will be folded through approximately 180° upon the panel 30 with the edge portion indicated at 32 of the panel 28 in engagement with the glue flap 31. Thereafter, the glued area will pass by the press rolls to cause the glue to adhere and thus form the side seam in the carton.

From the creasing rolls 20 the blank is fed onto first and second conveyor belts 35 and 36. The conveyor belts pass over pulleys 37 fixed to an idler shaft 38 at the upstream end of the conveyor and pass over pulleys 39 fixed to an idler shaft 40 at the downstream end of the conveyor. The belts pass over idler pulleys and around a driving drum 41 (FIG. 1) which is driven from a common drive system to drive the belts 35 and 36 continuously during the operation of the mechanism.

The second belt 36 passes between five upstream pressure sections 42 and the first belt 35 passes between six downstream pressure sections 42. The relationship of the upstream and downstream pressure sections is always such as to assure positive gripping and control of the blank as it moves through the mechanism. Each pressure section is illustrated in FIG. 4 and includes a set of four bottom idler rollers 45 and three upper idler rollers 46 which overlie the spaces between the lower rollers 45. The belts 35 and 36, respectively, pass between the idler rollers. The upper rollers are spaced close to the lower rollers so that the belt undulate as they pass between them. As the tension on the belts is increased, the pressure of the belts on the rollers will increase. A carton blank riding on the belts will be pressed by the upper rollers 46 against the belt so as to provide good driving contact of the belt against the carton blank to move it through the mechanism.

Each set of upper rollers is rotatably mounted in a channel 47 which is bolted to a plate 48 fixed to a post 49. The post is clamped to a channel 50 which extends the length of the folding and sealing mechanism 15.

At the upstream end of the mechanism, a wedge-shaped stationary plow 55 is located in the path of the panel 27 of the blank 11. The plow has a stationary ramp 56 which causes the panel 27, as the blank moves past it, to swing upwardly through an angle of approximately 20°. Immediately downstream of the plow 55 is a rotating plow 58 mounted on a shaft 59. The rotating plow is generally circular and has a sector 60 removed. The sector is defined by a trailing edge 61 and an upturned leading edge 62 which is engageable with the panel 27 to fold it over. The longitudinal movement of the carton blank is timed as it is ejected from the magazine 10 so that the leading edge of the carton blank moves into the open sector as the sector is facing upstream. As the blank is advanced, the upturned leading edge 62 of the rotating plow engages the upwardly angulated panel 27. Continued rotation of the plow as the blank advances causes the panel 27 to be folded over upon the remainder of the blank as illustrated in FIG. 2. A breaker bar or shoe 65 underlies the blank during its excursion past the rotating plow. The bar 65 has an edge 66 which is in alignment with the crease between panels 27 and 29 (either preformed or about to be formed by the plow) to assist in holding the blank in a proper orientation during the folding operation and to provide a straight edge about which to fold the panel.

The breaker bar also overlies the first conveyor belt 35 so that there is a certain amount of frictional contact between the belt 35 and the carton blank, imparting forward motion to the blank which keeps the blank from skewing as it is driven past the rotating plow principally by the upstream pressure sections 42 associated with the second belt 36. upon An elongated bar 70 is located between the two belts 36 and positioned to underlie the glue flap 31 after the panel 27 has been folded upn the blank. A conventional glue wheel 71 is located downstream of the rotating plow 58 and overlies and is slightly spaced above the bar 70. This arrangement of glue wheel 71 and bar 70 provides assurance that the glue will be positively applied to the glue flap and not to the rest of the blank or any other machinery.

As the blank is conveyed beyond the rotating plow and under the glue wheel 71, the driving force is transferred from the second belt 36 to the first belt 35 by means of the pressure sections 42 associated with the first belt. Thus driven, the blank is moved under the glue wheel 71 and glue is applied only to the glue flap 31.

Immediately downstream of the glue wheel, panel 30 of the blank passes under a second breaker bar 72 which has an edge 73 which coincides with the crease 25 between panels 30 and 32. The breaker bar 72 lies closely adjacent to the second belt 36 and effects a frictional contact of the belt with the blank so as to aid in the conveying of the blank and in thus preventing skewing of the blank in respect to the longitudinal axis of the mechanism. The bar 72 is elongated and extends underneath a second rotary plow 75 and provides the edge against which the panel 32 is rotated during the final state of the folding operation.

Downstream of the glue wheel, the second rotating plow 75 is mounted on the opposite side of the conveyor from the first rotating plow 58. A second stationary plow 76 is fixed immediately ahead of the rotating plow 75 and has a ramp 77 which is engageable with the panel 28 of the blank to begin its upward swinging with respect to the fold line between the panel 28 and the panel 30. The stationary plow has a downstream vertical section 78 which holds the panel 28 in a generally perpendicular attitude with respect to the blank as the blank leaves the stationary plow 76 and moves past the rotating plow 75.

The rotating plow 75 is similar to the plow 58 and is generally circular, having a sector 79 removed. Again the sector 79 is defined by a trailing edge 80 and an upturned leading edge 81. As the blank is advanced from the glue wheel, the leading edge of the panel 28 moves into the sector 79 and is engaged by the upturned leading edge 81 of the rotating plow 75. As the rotating plow continues to advance, it folds the panel 28 over upon the blank with the edge portion 32 of the panel 28 moving into engagement with the glue flap 31 to which glue has been applied.

Advance of the blank is continued by the pressure sections 42 associated with the belt 35 until the blank moves through the nip 82 between upper and lower press rolls 83, 84 (see FIG. 6). The nip 82 is aligned with the overlapping glue flap 31 and edge portion 32 so as to press the two together and cause the glue to adhere thereby completing the sealing of the blank.

As shown in FIG. 1, immediately downstream of the press rolls 83, 84 is a photoelectric double blank detector 87. If the carton blank consists of a single blank, is is fed into the ejectorsection 16 which thrusts the blank into the magazine 17. If more than one blank has been folded together, the outer blank will have an unsealed panel 28 projecting upwardly which passes through a light beam to a photocell in the detector 87. The thickness detector 87 signals the reject mechanism 19 to cause the blank to be diverted from the magazine 17 and into a waste container, not shown. The ejector section consists of a driven endless belt 88 which overlies a series of idler rollers 89, the blanks passing between the idler rollers and the belt 88. The ejector belt 88 imparts a substantial longitudinal velocity to the blank to assure that the blank drops properly into the magazine 17 or it is properly rejected if it has been improperly formed.

The rejector mechanism consists of diverter plate 90 pivotally mounted at 91 to a bracket 92. An arm 93 is fixed to the plate and is connected to a double acting piston and cylinder combination 94. The cylinder is pivoted at 95 to the bracket 92 and the piston has a rod 96 pivoted at 97 to the arm 93. The piston and cylinder are controlled by the detector 87 so as to cause the diverter to swing in a clockwise direction when an imperfect blank is detected to bring the plate in the attitude shown in broken lines in FIG. 1. In this attitude, it can be seen that a blank will skip over the cartoner magazine 17 and thus be ejected from the system. Immediately following the rejecting of the blank, the piston and cylinder combination moves the diverter to its original attitude shown in full lines which permits the blank to be fed into the magazine 17.

As is diagrammatically illustrated in FIG. 1, the mechanism has a single drive 100 which is connected to the several operating elements of the mechanism including the ejector 12 for the magzine, the conveyor belts 35, 36, the rotary plows and the ejector mechanism 16.

In the operation of the invention, flat carton blanks 11 are ejected from the stack in the magazine 10 into the nip between the crease rollers 20. As the blanks pass between the crease rollers 20, the blanks are creased along the fold lines to define the four panels and the glue flap 31.

Immediately downstream of the creasing rollers the blank is captured by the first pressure section 42 and is positively driven downstream by the belt 36. As the blank continues to advance, the panel 27 rides up the ramp 56. As the leading edge of the panel 27 passes over the ramp 56, it is engaged by the unturned edge 62 of the first rotating plow 58 and folded over through an angle of approximately 180° until the glue flap 31 rests upon the bar 70. After the blank passes the first rotating plow, it is captured by the pressure sections 42 associated with the belt 35 which will ultimately provide the primary drive to convey the blank through the rest of the folding mechanism.

While under driving control from the pressure sections associated with the belts 35 and 36, the blank is conveyed past the glue applicator wherein the glue roll 71 contacts the glue flap 31 and applies a series of glue spots to the glue flap. As glue is being applied, the panel 28 is passing over a stationary plow 76 which swings the panel 28 up to approximately 90°. Continued advance of the blank by the pressure sections 42 and belt 35 brings the leading edge of the panel 28 into the open sector 79 of the rotating plow 75 where it is engaged by the upturned leading edge 81 of the plow and folded through the remainder of the 180°. The complete folding of the panel 28 brings its edge portion 32 into contact with the applied glue on the glue flap 31. Thereafter, the conveyor drives the blank between the nip of the press rolls 82, 83 to force the edge portion 32 of panel 28 against the glue flap 31 to effect the formation of the side seam of the carton.

As the blank leaves the press rolls 82, 83, it is captured by the ejector and thrust forward into the magazine 17. As indicated above, if the blank is imperfectly formed, as by folding two blanks together, that extra thickness will be detected by the detector 87, thereby causing the operation of the diverter 90 which causes the blank to be diverted past the magazine and into a waste receptacle.

In the foregoing, the preferred form of the invention has been described. It is to be understood that modifications can be made in the apparatus without departing from the scope of the claims which follow. For example, instead of employing two rotating plows as illustrated in the preferred form of the invention, it is contemplated that cartons can be folded and glued with a single rotating plow. In such form of the invention a stationary plow will be provided for folding the glue flap 31 over upon the panel 27 and thereafter using a rotating plow to fold panels 28 and 30 over upon the blank with the edge portion 32 of panel 28 overlying the glue glap 31.

Further, the location of the glue applicator does not necessarily have to be between the two plow sections, but rather can be located at any convenient position on the apparatus for applying glue either to the glue flap 31 or to the marginal portion 32 of panel 28 before they are brought together in overlying relation.

Having described my invention, I claim:

1. Apparatus for folding and gluing a blank into a carton having two outboard panels, two inboard panels and a glue flap at the edge of one outboard panel adhesively secured to the edge of the opposite outboard panel, said panels and glue flap being defined by fold lines, said apparatus comprising, a conveyor for feeding carton blanks in a direction parallel to their folded lines, a first rotatable plow on one side of said conveyor for folding said glue flap and outboard panel over upon said one outboard panel, conveyor means on the other side of said conveyor opposite said first rotatable plow for tightly gripping the upper and lower sides of said one outboard panel to convey said blank past said first rotatable plow while holding said blank securely in longitudinal alignment, means downstream of said rotatable plow for applying glue to said glue flap, a second rotatable plow located downstream of said glue-applying means and on the opposite side of said conveyor from said first rotatable plow for folding said opposite outboard panel on the other side of said blank over upon said blank with an edge portion overlying the glue flap of the first panel, conveyor means securely gripping the upper and lower surfaces of said folded blank and located on the side of said conveyor opposite to said second rotatable plow to securely grip said blank and maintain it in longitudinal alignment, and means downstream of said rotatable plow for pressing said edge portion and glue flap together.

2. Apparatus as in claim 1 further comprising, a stationary plow immediately upstream of each rotating plow and engageable with a respective panel to begin to fold said panel prior to its engagement by a respective rotating plow.

3. Apparatus as in claim 1 further comprising, an elongated breaker bar adjacent each rotating plow and having a longitudinal edge in alignment with the fold line of a respective panel to hold down an adjoining portion of the blank as the panel is being folded over.

4. Apparatus as in claim 1 further comprising, a plurality of sets of creasing rolls upstream of said first plow to apply longitudinal creases to each blank coinciding with at least some of the fold lines of said blank.

5. Apparatus for folding and gluing a carton comprising, a conveyor for feeding carton blanks in a direction parallel to their fold lines, a first rotatable plow on one side of said conveyor for folding a first panel on one side of the blank over upon the blank, a second rotatable plow downstream of said first plow on the other side of said conveyor for folding a panel on the other side of the blank over upon the blank with an edge portion overlying an edge portion of said first panel, a glue applicator between said plows for applying glue to one of said edge portions, and means, downstream of said second plow, for pressing said edge portions together, said conveyor comprising, first and second laterally spaced endless belts passing between and adjacent said first and second plows, respectively, a first pressure section located opposite said first plow and associated with said second belt, a second pressure section located opposite said second plow and associated with said first belt, each said pressure section including means for pressing said blank against said belt to securely grip said blank and drive said blank longitudinally at least during the plowing operation of the respective plow while maintaining longitudinal alignment of said blank.

6. Apparatus as in claim 5 in which each said pressure section comprises a plurality of longitudinally spaced rollers above and below a respective belt, the rollers above said belt creating with said belt a nip into which each blank is fed, said upper rollers pressing said blank against said belt.

7. Apparatus as in claim 6 in which said upper rollers overlie spaces between said lower rollers, sid upper rollers being spaced close to said lower rollers to cause an undulation of said belt passing therebetween.

8. Apparatus for folding and gluing a carton comprising, a conveyor for feeding carton blanks in a direction parallel to their fold lines, a first rotatable plow on one side of said conveyor for folding a first panel on one side of the blank over upon the blank, a second rotatable plow on the other side of said conveyor for folding a panel on the other side of the blank over upon the blank with an edge portion overlying an edge portion of said first panel, a glue applicator between said plows for applying glue to one of said edge portions, mean, downstream of said second plow, for pressing said edge portions together, means for detecting improperly folded blanks, and means controlled by said detecting means for rejecting such improperly folded blanks.

* * * * *

UNITED STATES PATENT AND TRADEMARK OFFICE

CERTIFICATE OF CORRECTION

PATENT NO. : 4,056,046

DATED : November 1, 1977

INVENTOR(S) : Charles C. Hughes

It is certified that error appears in the above-identified patent and that said Letters Patent are hereby corrected as shown below:

Claim 1, Column 6, line 46, delete "one outboard panel" and insert -- blank --

Signed and Sealed this

Ninth Day of May 1978

[SEAL]

Attest:

RUTH C. MASON
Attesting Officer

LUTRELLE F. PARKER
Acting Commissioner of Patents and Trademarks